US006283784B1

(12) United States Patent
Torii

(10) Patent No.: US 6,283,784 B1
(45) Date of Patent: Sep. 4, 2001

(54) PRESS-CONTACT TERMINAL FITTING

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/546,562

(22) Filed: Apr. 11, 2000

(30) Foreign Application Priority Data

Apr. 26, 1999 (JP) ..... 11-118314

(51) Int. Cl.[7] ..... H01R 4/24; H01R 4/26; H01R 11/20

(52) U.S. Cl. ..... 439/397

(58) Field of Search ..... 439/397, 399, 439/407, 405

(56) References Cited

U.S. PATENT DOCUMENTS 6,007,365 * 12/1999 Atsumi et al. ..... 439/397
6,019,626 * 2/2000 Abe ..... 439/399
6,080,005 * 6/2000 Aoyama et al. ..... 439/397

FOREIGN PATENT DOCUMENTS 10-12291 1/1998 (JP) .

* cited by examiner

*Primary Examiner*—Brian Sircus
*Assistant Examiner*—Brian S. Webb
(74) *Attorney, Agent, or Firm*—Morgan, Lewis & Bockius LLP

(57) ABSTRACT

A sheathed electric wire is fitted between a pair of opposed clamping plates. A press-contact blade is formed inside of the respective clamping plates for cutting a sheath of the sheathed electric wire to electrically connecting with a conductive wire thereof when the sheathed electric wire is fitted between the clamping plates. A pair of holding strips are bent to hold the sheathed electric wire fitted between the clamping plates. A pair of connecting plates integrally connect the clamping plate and the holding strip, respectively. A dimension of a portion where the connecting plate is connected to the clamping plate is shorter than a dimension of a portion where the connecting plate is connected to the holding strip.

2 Claims, 6 Drawing Sheets

PRESS-CONTACT TERMINAL FITTING

BACKGROUND OF THE INVENTION

The present invention relates to a press-contact terminal fitting, and more specifically, the present invention relates to a structure of a press-contact terminal fitting comprising a press-contact section for press-fitting an end portion of a sheathed electric wire and holding strips for crimping the sheathed electric wire.

As one of press-contact terminal fittings of this type, a press-contact terminal fitting 3, as shown in FIG. 5, to be disposed in the housing 2 of the connector 1 to be connected to a circuit board (printed board) has been used. FIG. 6 is a cross sectional view taken along the line B—B of FIG. 5. The connector 1 is, as shown in the FIG. 5, disposed and fixed on the wiring board (printed board) 4. The connector 1 is provided with insertion legs 1A projecting from the bottom thereof for securing it to the wiring board 4 (refer to FIG. 6). In the housing 2 of the connector 1, there are provided a plurality of open-top chambers 2A for accommodating the sheathed electric wires 5 arranged in parallel. On one of side walls 2B of the housing 2, as shown in FIG. 5, there are provided openings 2C in communication with respective chambers 2A for leading out the sheathed electric wires 5.

The press-contact terminal fitting 3 is, as shown in FIG. 7, formed by punching and bending a metal plate, and provided with a press-contact section 6 for electrically press-contacting with the sheathed electric wire 5 and a holding section 7 for surrounding and holding the sheathed electric wire 5. Depicted by a reference numeral 8 in FIG. 7 is a connecting strip which projects downwardly when the terminal fitting is accommodated in the connector 1.

The press-contact section 6 of the press-contact terminal fitting 3 comprises, as shown in FIG. 7 and FIG. 8, a pair of opposed clamping plates 6A and 6B standing upwardly from both sides of the press-contact terminal fitting 3 for clamping the wire. The clamping plates 6A and 6B respectively include two each of press-contact blades 6C and 6D, which are bent inwardly so as to project toward each other. In this press-contact section 6, the sheathed electric wire 5 is press-fitted from above as shown in FIG. 8A, and the resin sheath 5A of the sheathed electric wire 5 is cut by the press contact blades 6C and 6D so that the press contact blades 6C and 6D are directly connected to the core conductive wire 5B of the sheathed electric wire 5.

The holding section 7 is composed of a pair of holding strips 7A and 7B standing upwardly from both sides of the press-contact terminal fitting 3. In order to hold the sheathed electric wire 5 with the holding section 7, as shown in FIG. 9A, the sheathed electric wire 5 is placed between the holding strips 7A and 7B and crimped by the use of a jig (punch) as shown in FIG. 9B. As a result, as shown in FIG. 9B, a pair of holding strips 7A and 7B are in press-contact with the resin sheath 5A to hold the sheathed electric wire 5.

The press-contact section 6 and the holding section 7 disposed behind thereof are connected by rectangular shaped connecting plates 3A shown by a hatched area in FIG. 7. The connecting plates 3A effect to reinforce and prevent the clamping plates 6A and 6B from being urged outwardly when the sheathed electric wire 5 is press-fitted between the clamping plates 6A and 6B.

However, when the related press-contact terminal fitting 3 is used to connect and hold the sheathed electric wire 5, the following problem is encountered.

After the sheathed electric wire 5 is press-fitted into the press-contact section 6 and an electrical connection of established, when the holding strips 7A and 7B on the holding section 7 are crimped as shown in FIG. 9B, a force to urge the clamping plates 6A and 6B in the direction shown by the arrow a is exerted in conjunction with the bending operation of the holding strips 7A and 7B. Therefore, the press-contact blades 6C and 6D may move closer with respect to each other and may cut off the core conductive wire 5B of the sheathed electric wire 5. On the contrary, in the case where the sheathed electric wire 5 is press-fitted into the press-contact section 6 after the sheathed electric wire 5 is held by bending the holding strips 7A and 7B, the core conductive wire 5B may be cut off because the distance between the press-contact blades 6C and 6D is decreased.

SUMMARY OF THE INVENTION

Therefore, the object of the invention is to find a measure to provide a press-contact terminal fitting which ensures the electrical connection without cutting off the core conductive wire of the sheathed electric wire when the sheathed electric wire is press-fitted and held.

In order to achieve the above object, according to the present invention, there is provided a press-contact terminal fitting comprising:

- a pair of opposed clamping plates between which a sheathed electric wire is to be fitted;
- a press-contact blade formed inside of the respective clamping plates for cutting a sheath of the sheathed electric wire to electrically connecting with a conductive wire thereof when the sheathed electric wire is fitted between the clamping plates;
- a pair of holding strips which are to be bent to hold the sheathed electric wire fitted between the clamping plates; and
- a pair of connecting plates for integrally connecting the clamping plate and the holding strip, respectively,
- wherein a dimension of a portion where the connecting plate is connected to the clamping plate is shorter than a dimension of a portion where the connecting plate is connected to the holding strip.

Accordingly, when the holding strips are bent to hold the sheathed electric wire placed between the clamping plates, the tendency of a tensile stress caused by the bending action to be transmitted to the clamping plates will be reduced at the portion where the dimension of the connecting plate is short in height. In other words, the tendency of the moment applied to the holding strips in the direction of bending to cause a tensile stress to be transmitted will be reduced because the dimension of the connecting plate on the side of clamping plate is short in height. Therefore, it may prevent the press-contact blades formed on the opposed surfaces of the clamping plates from getting closer, and thus prevent the core conductive wire of the sheathed electric wire from being cut. A press-contact terminal fitting with a high degree of reliability can be realized at a low cost.

Preferably, The pair of holding strips includes a first holding strip and a second holding strip which is arranged closer to the associated clamping plate than the first holding strip. Here, a dimension of a portion where the connecting plate associated with the second holding strip is connected to the clamping plate is shorter than a dimension of a portion where the connecting plate associated with the first holding strip is connected to the clamping plate.

Accordingly, since the positions of the holding strips in the longitudinal direction are displaced with respect to each other, sufficient length of holding strips for holding the sheathed electric wire can be obtained securely to improve the durability of the connection of the wire. In addition, there can be prevented a tensile stress caused by the action to bend the holding strips from being transmitted to the side of the clamping plates which may result in cutting off of the core conductive wire of the sheathed electric wire.

Preferably, the clamping plates and the holding strips are to be accommodated in a connector housing made of an insulating material.

Accordingly, since the connecting plates prevent the clamping plate from being widened (fell down) outwardly, inner walls of a chamber of the connector housing for accommodating the terminal fitting may not damaged.

DETAILED DESCRIPTION OF THE PREFERRED EMBODIMENTS

Figure 1:
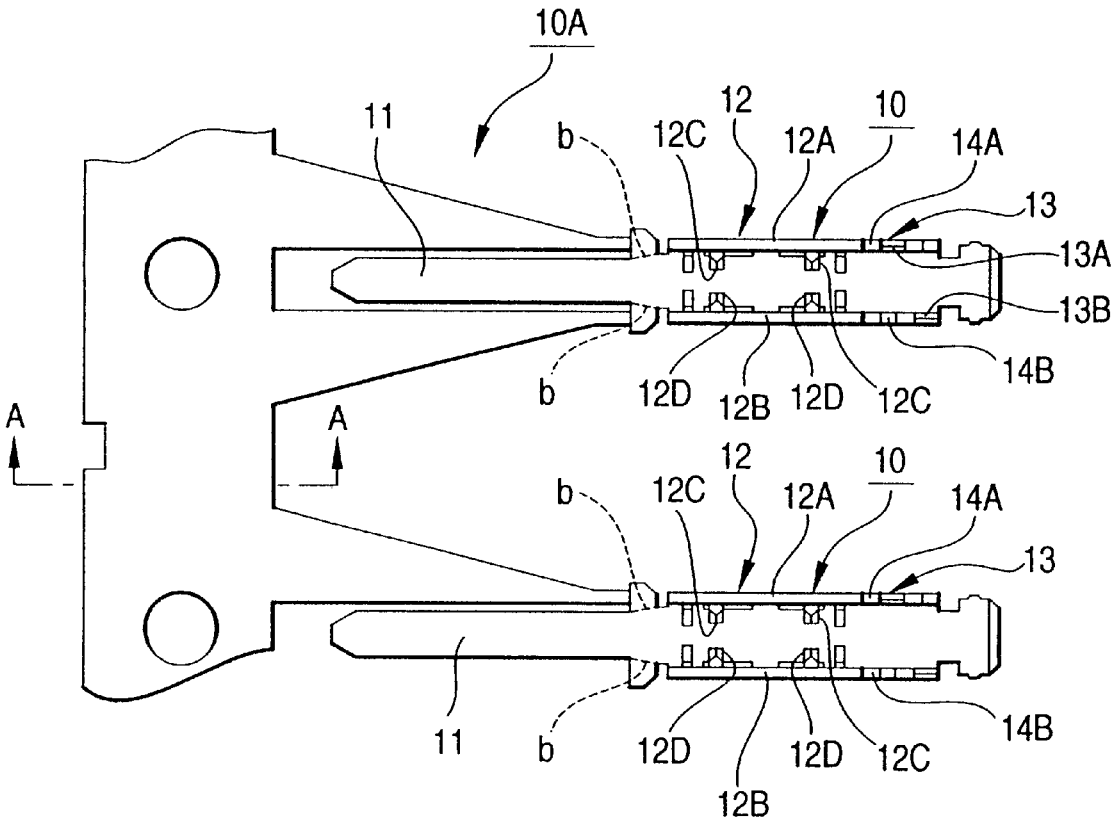
FIG. 1 is a plan view of a press-contact terminal fitting fabricated in a chained component according to an embodiment of the present invention.

Referring now to the drawings, an embodiment of the press-contact terminal fitting according to the present invention will be described.

Figure 2:
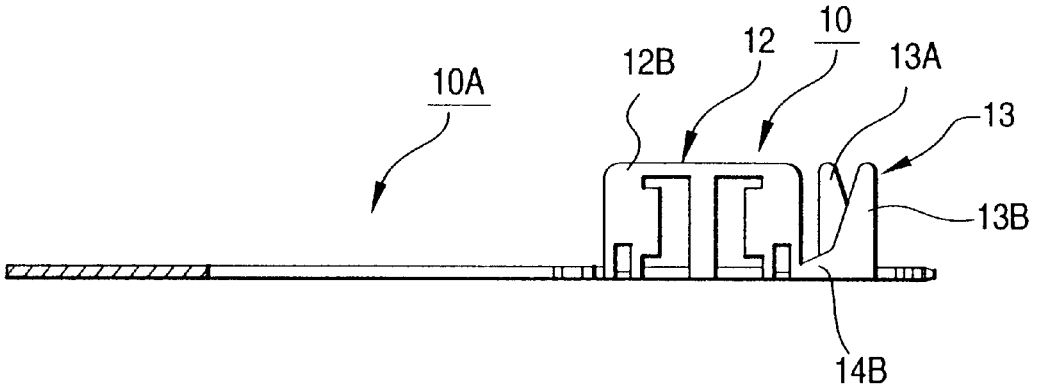
FIG. 2 is a cross sectional view taken along the line A—A of FIG. 1.
Figure 3:
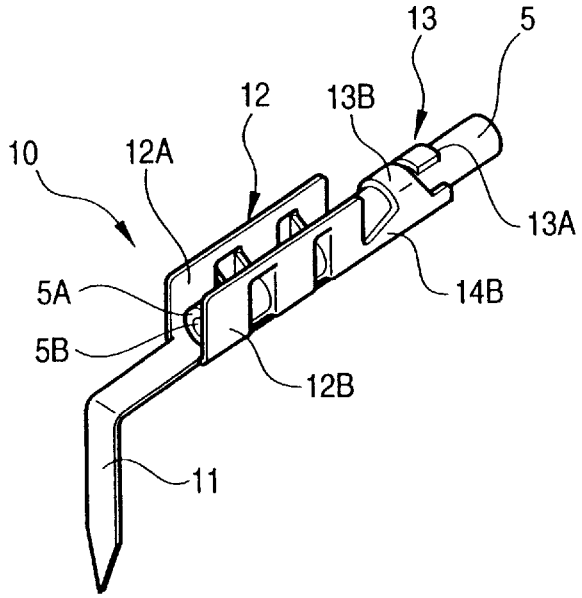
FIG. 3 is a perspective view of the press-contact terminal fitting of the present invention with a sheathed electric wire attached.
Figure 4A:
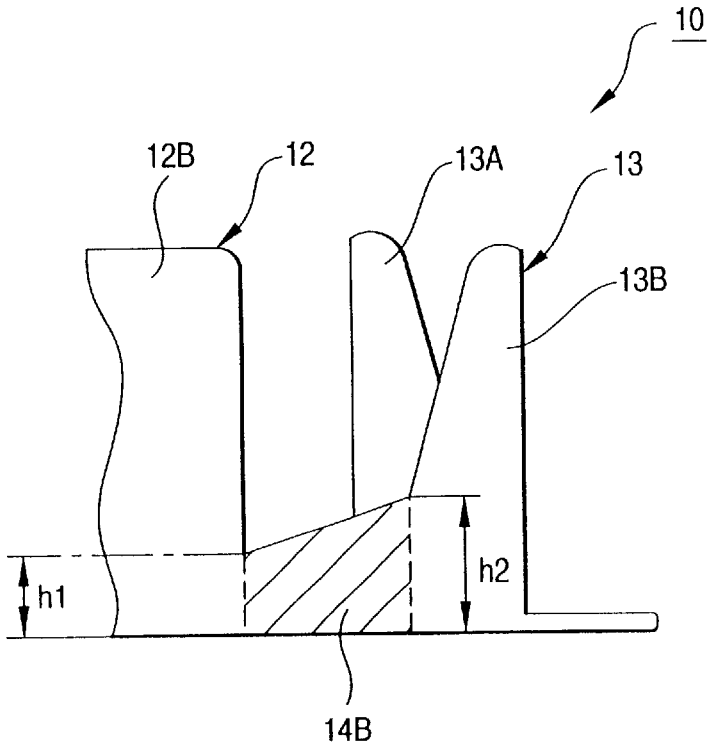
FIG. 4A is a side view of an essential portion of the press-contact terminal fitting according to the present invention.
Figure 4B:
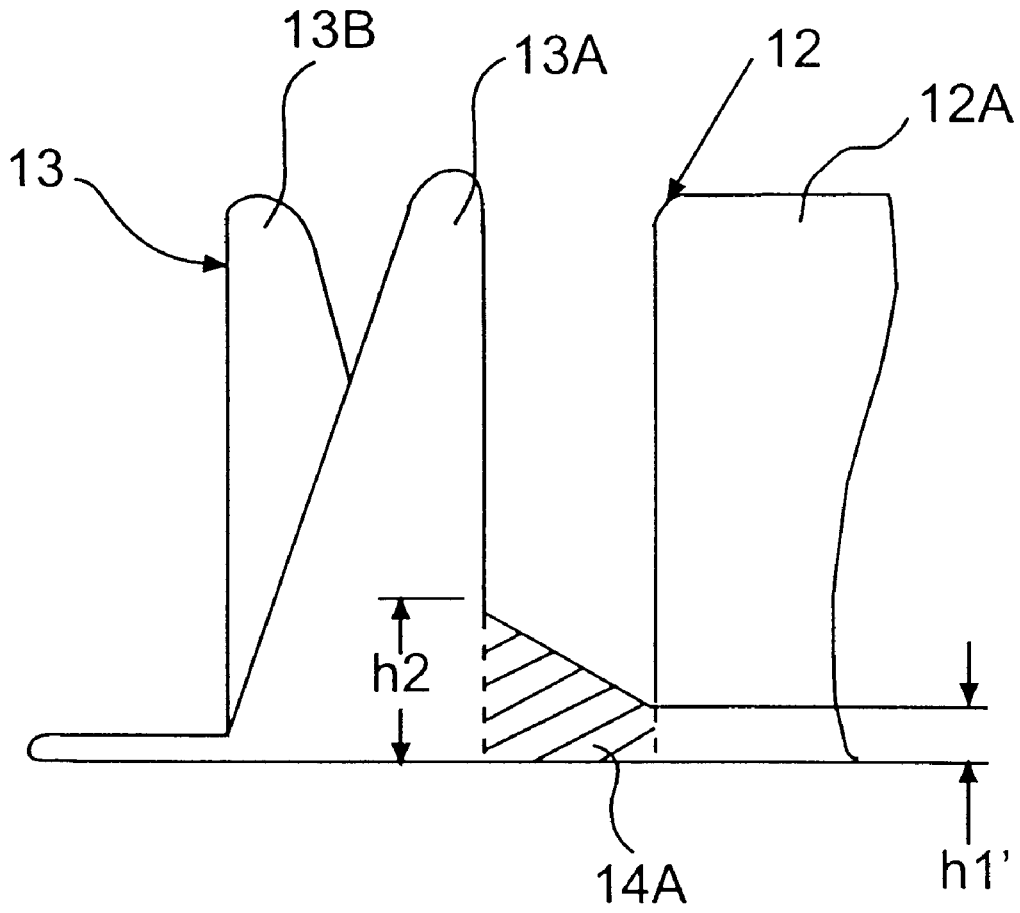
FIG. 4B is a side view, looking in the opposite direction of FIG. 4A, of another essential portion of the press-contact terminal fitting according to the present invention.

FIG. 1 to FIG. 4B illustrate an embodiment of the press-contact terminal fitting according to the present invention. FIG. 1 is a plan view illustrating a plurality of continuously fabricated press-contact terminal fittings 10 after the punching and bending processes have been performed; FIG. 2 is a cross sectional view taken along the line A—A in FIG. 1; FIG. 3 is a perspective view illustrating the press-contact terminal fitting 10 with a sheathed electric wire mounted; FIG. 4A is a side view showing the essential portion of a press contact terminal fitting; and FIG. 4B is a side view, looking in the opposite direction of FIG. 4A, showing another essential portion of the press contact terminal fitting.

Figure 5:
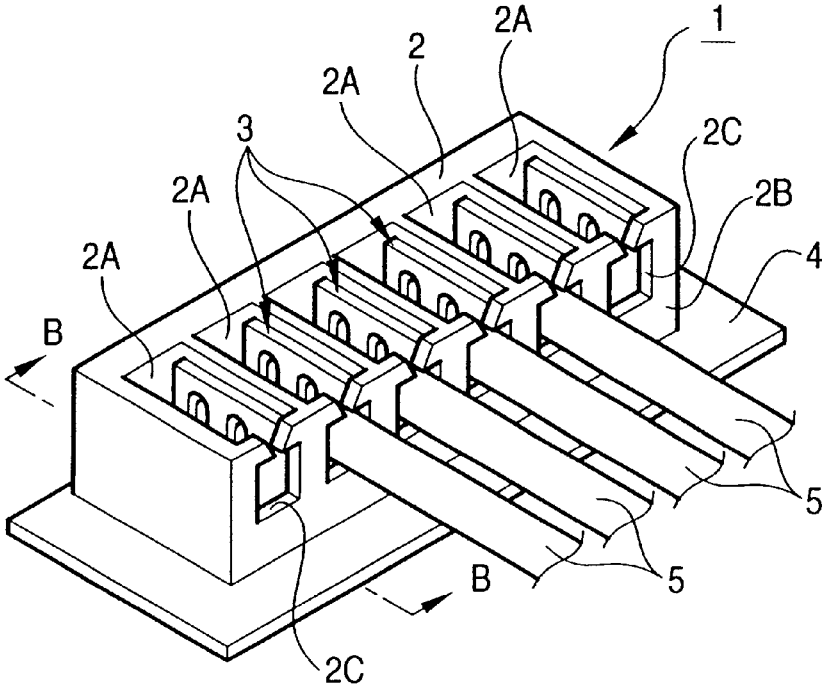
FIG. 5 PRIOR ART
FIG. 5 is a perspective view of the related press-contact terminal fitting in use.
Figure 6:
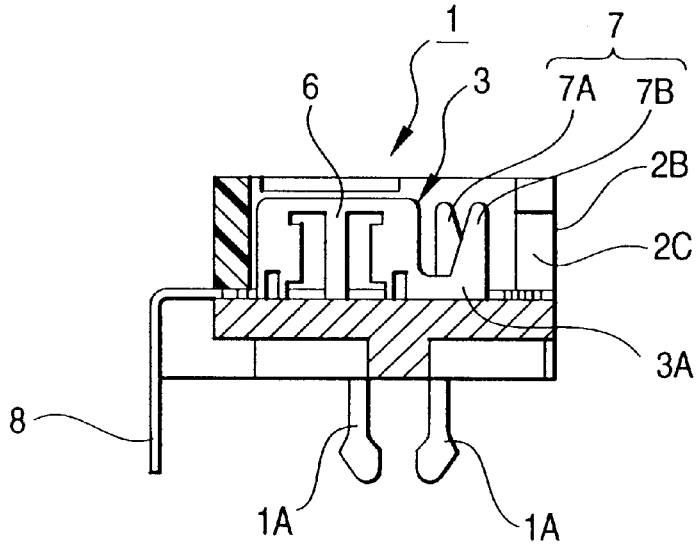
FIG. 6 PRIOR ART
FIG. 6 is a cross sectional view taken along the line B—B in FIG. 5.
Figure 7:
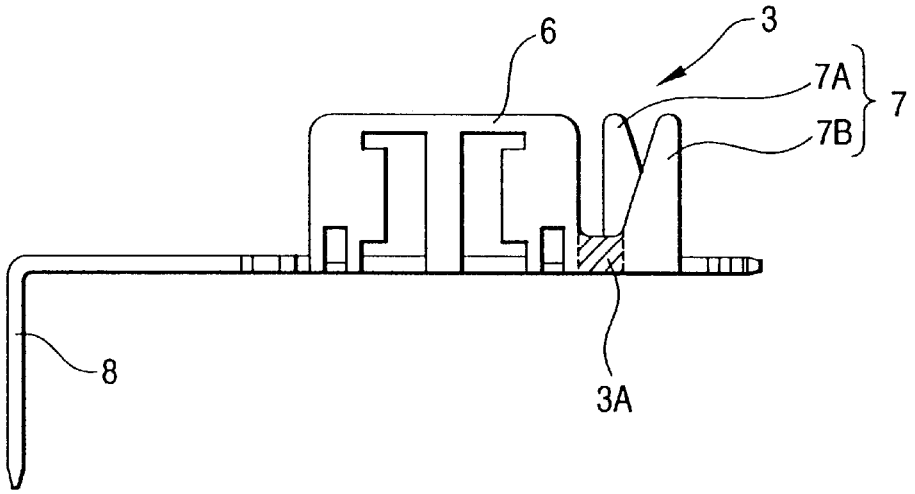
PRIOR ART FIG. 7
FIG. 7 is a side view of the related press-contact terminal fitting.
Figure 8A:
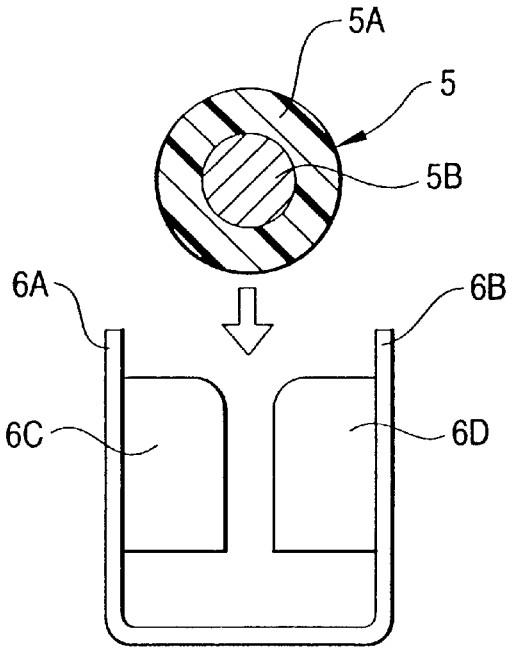
PRIOR ART FIG. 8A
FIGS. 8A and 8B are explanatory cross sectional views of a related press-contact terminal fitting illustrating the state where a sheathed electric wire is press-fitted therein.
Figure 8B:
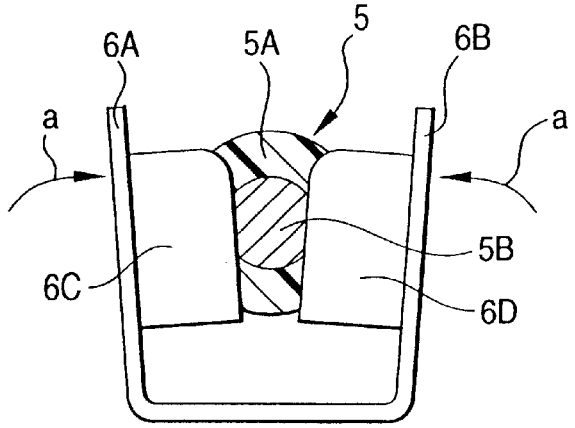
PRIOR ART FIG. 8B
Figure 9A:
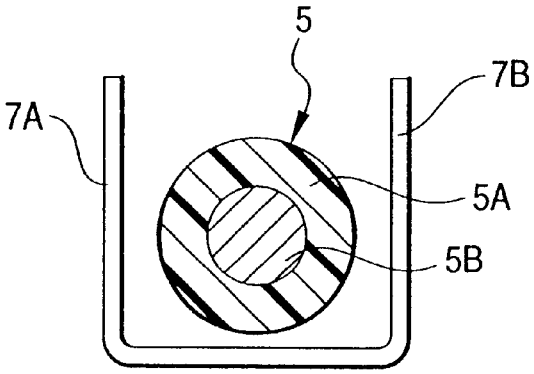
PRIOR ART FIG. 9A
FIGS. 9A and 9B are explanatory cross sectional views of the related press-contact terminal fitting illustrating a process to bend the holding section for holding the sheathed electric wire.
Figure 9B:
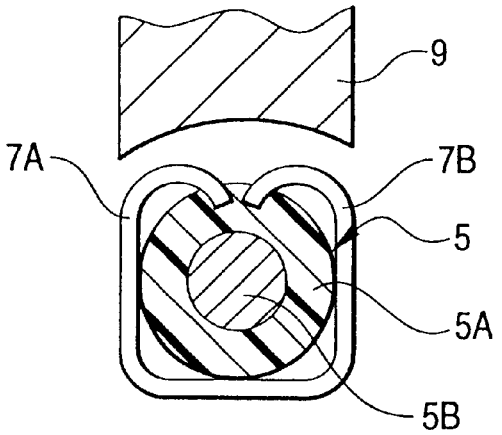
PRIOR ART FIG. 9B

The press-contact terminal fitting 10 of the present invention may be provided as a chained component 10A fabricated by performing punching and bending processes to a metal plate as shown in FIG. 1. By cutting along the dotted line b shown in FIG. 1, a single press-contact terminal fitting 10 is obtained. The press-contact terminal fitting 10 of the present invention is to be disposed in the housing 2 of the connector 1 as shown in FIG. 5 as is the related press-contact terminal fitting 3 described above.

Referring now to FIG. 1 to FIG. 4B, the press-contact terminal fitting 10 of the present embodiment will be described. The press-contact terminal fitting 10 comprises a connecting strip 11 projecting downwardly from the bottom of the connector when it is stored in the connector, not shown, a press-contact section 12 to which the sheathed electric wire 5 is press-fitted, and a holding section 13 for surrounding and holding the sheathed electric wire 5.

The press-contact section 12 of the press-contact terminal fitting 10 comprises, as shown in FIG. 1 to FIG. 3, a pair of opposed clamping plates 12A and 12B for holding the sheathed electric wire, which stand upwardly from both sides of the press-contact terminal fitting 10. Respective clamping plates 12A and 12B are provided with two each of press-contact blades 12C and 12D which are bent inwardly so as to project toward each other. In this press-contact section 12, the sheathed electric wire 5 is press-fitted from above as shown in FIG. 3, and the resin sheath 5A of the sheathed electric wire 5 is cut by the press contact blades 12C and 12D so that the press contact blades 12C and 12D come into contact with the core conductive wire 5B of the sheathed electric wire 5 to establish an electrical connection between them.

The holding section 13 is formed in such a manner that a pair of holding strips 13A and 13B standing upwardly from both sides of the press-contact terminal fitting 10 are formed opposing with each other. To hold the sheathed electric wire 5 with this holding section 13, the sheathed electric wire 5 is placed between the holding strips 13A and 13B as well in the related art, and crimped by the use of a jig. As a result, a pair of holding strips 13A and 13B are in press contact with the sheathed electric wire 5A as shown in FIG. 3 so as to hold the sheathed electric wire 5.

The press-contact section 12 and the holding section 13 disposed behind thereof are connected by the connecting plate portion 14 (14A, 14B). The upper edge of the connecting plate 14 (14B), shown in a hatched area in FIG. 4A, is tapered so that the height h1 on the side of the clamping plate 12B is shorter then the height h2 on the side of the holding strip 13B. In this embodiment, as for the connecting plate 14A as well, the height on the side of the clamping plate 12A is shown by h1 and the height on the side of the holding strip 13A is shown by h2 as in the connecting plate 14B, the tapered angle differs from that of the connecting plate 14B.

In this embodiment, since there is provided connecting plates 14 (14A, 14B), it is reduced the tendency of a tensile stress in the direction of bending generated at the bending portion 13 to be transferred to the clamping plates 12A and 12B when the holding strips 13A and 13B of the bending portion 13 are bent inwardly. In other words, by bending the holding strips 13A and 13B to hold the sheathed electric wire 5 after press-fitting the sheathed electric wire 5 into the press-contact section 12 and establishing an electrical connection between the core conductive wire 5B and the press-contact blades 12C and 12D, the tendency of a tensile stress generated by the bending operation of the holding strips 13A and 13B to be transferred to the clamping plates 12A and 13B are reduced. Therefore, it may reduce tendency of a stress to move the press-contact blade 12C and the press-contact blade 12B in the direction toward each other to be exerted and the core conductive wire 5B of the sheathed electric wire 5 may be protected from being cut off. When press-fitting the sheathed electric wire 5 in the state being clamped by the bending portion 13, the tendency of a tensile stress generated at the holding section 13 by the bending operation to be transmitted to the press-contact section 12 is reduced, and thus the press-contact blades 12C and 12D is prevented from moving too close with respect to each other. Therefore, in the case where the connecting plate 14 is not formed between the press-contact section 12 and the holding section 13 at all, the clamping plates 12A and 12B are likely to be urged outwardly, which may result in the detrimental effects such that the wall portion of the housing 2 of the connectors shown in FIG. 5 is likely to be damaged when the conductor is press-fitted. Therefore, the press-contact fitting 10 having a structure according to this embodiment may prevent the connectors from being damaged.

While a preferred embodiment of the invention has been described, it is to be distinctly understood that the invention is not limited thereto, but may be otherwise variously embodied according to the principle of the construction. For example, in the embodiment shown above, the shorter dimensions h1 of the connecting plates 14A and 14B are the same length in height. However, since the holding strip 13A is positioned closer to the press-contact section 12 than the holding strip 13B, a tensile stress is more likely to be transmitted by the action such as press-fitting of the sheathed electric wire 5 into the press contact portion 12 or bending of the holding strip at the holding section 13. Therefore, as shown in FIG. 4B, as compared to FIG. 4A, it is also possible to make the shorter dimension in height of the connecting plate 14 which connects the holding strip located closer to the press contact portion 12 and the clamping plate shorter than the shorter dimension in height of the other connecting plate (i.e. h1' vs. h1 ), to have the geometry wherein the tendency to transfer a tensile stress is reduced.

While the press-contact terminal fitting 10 includes a long connecting strip 11 in the embodiment shown above, it may be a configuration having no connecting strip 11, and other structures may be modified as far as there is provided between the press-contact section 12 and the holding section 13 a tapered connecting plate 14 wherein the dimension on the side of the press-contact section is shorter in height.

What is claimed is:

1. A press-contact terminal fitting comprising:

a pair of opposed clamping plates between which a sheathed electric wire is to be fitted;

a press-contact blade formed inside of the respective clamping plates for cutting a sheath of the sheathed electric wire to electrically connect with a conductive wire thereof when the sheathed electric wire is fitted between the clamping plates;

a pair of holding strips which are to be bent to hold the sheathed electric wire fitted between the clamping plates; and a pair of connecting plates, each connecting plate integrally connecting one of the clamping plates and one of the holding strips, respectively, wherein a dimension of a portion where each of the connecting plates is connected to a clamping plate is shorter than a dimension of a portion where each of the connecting plates is connected to a holding strip;

wherein the pair of holding strips includes a first holding strip and a second holding strip which is arranged closer to the associated clamping plate than the first holding strip; and wherein a dimension of a portion where the connecting plate associated with the second holding strip is connected to the clamping plate is shorter than a dimension of a portion where the connecting plate associated with the first holding strip is connected to the clamping plate.

2. The press-contact terminal fitting as set forth in claim 1, wherein the clamping plates and the holding strips are to be accommodated in a connector housing made of an insulating material.

* * * * *